US005384755A

United States Patent [19]

Ferenczy

[11] Patent Number: 5,384,755

[45] Date of Patent: Jan. 24, 1995

[54] TIMEPIECE OF THE MECHANICAL OR ELECTROMECHANICAL TYPE INCLUDING A DRIVE WHEEL CONTROLLING AT LEAST ONE DISPLAY SYSTEM SUCH AS A DATE DISPLAY

[75] Inventor: Laszlo Ferenczy, Basel, Switzerland

[73] Assignee: Eta SA Fabriques d'Ebauches, Grenchen, Switzerland

[21] Appl. No.: 991,351

[22] Filed: Dec. 15, 1992

[30] Foreign Application Priority Data

Dec. 20, 1991 [CH] Switzerland ..... 03807/91-9

[51] Int. Cl.[6] ..... G04B 19/24

[52] U.S. Cl. ..... 368/35; 368/38

[58] Field of Search ..... 368/28, 37, 35, 40

[56] References Cited

U.S. PATENT DOCUMENTS

| | | | |
|---|---|---|---|
| 3,352,103 | 10/1965 | Giger | 368/35 |
| 3,732,687 | 5/1973 | Miyasaka et al. | 368/35 |
| 3,875,739 | 4/1975 | Mougin | 368/38 |
| 3,911,667 | 10/1975 | Komiyama | 368/38 |
| 3,983,691 | 10/1976 | Schaller et al. | 58/85.5 |
| 4,372,687 | 2/1983 | Krasovsky et al. | 368/28 |

FOREIGN PATENT DOCUMENTS 2311342 5/1976 France .

OTHER PUBLICATIONS

Latest Developments Incorporated in Bulova Sel-f-Winding Movement; Horological Journal No. 112, Mar. 1970 pp. 10–12 Shimmin.

*Primary Examiner*—Bernard Roskoski

*Attorney, Agent, or Firm*—Griffin Butler Whisenhunt & Kurtossy

[57] ABSTRACT

The invention concerns a timepiece. Such timepiece comprises: a horometric movement (1) including a motor pinion or intermediate wheel (2), a crown wheel with interior teeth (6) associated with a first display system, such as a date display, and a jumper spring (8), a driving wheel set (10) including a drive wheel (12) controlled by the motor pinion (2) and transmitting a motor couple received from the motor pinion to the crown (6) through a salient tooth (14), such wheel set (10) additionally including a hub (16) which is mounted to rotate freely relative to the movement and which elastically supports the drive wheel (12) through an elastic arm (22), such timepiece being characterized in that the elastic arm (22) which supports the drive wheel (12) has a basically C form winding around the hub (16), while the drive wheel (12) meshes directly with the motor pinion (2). The invention is applicable to a timepiece of the mechanical or electromechanical type.

10 Claims, 6 Drawing Sheets

TIMEPIECE OF THE MECHANICAL OR ELECTROMECHANICAL TYPE INCLUDING A DRIVE WHEEL CONTROLLING AT LEAST ONE DISPLAY SYSTEM SUCH AS A DATE DISPLAY

The invention concerns a timepiece of the mechanical or electromechanical type including a crown with interior teeth associated with a display system, such as a date display.

The present invention furthermore concerns a timepiece including a first display system of the type as mentioned hereinabove associated with a second display system such as a day of the week display, such second display system including a star which bears and drives a disc or day indicating means centered on the timepiece.

A timepiece provided with two display systems respectively dates and days is described in French patent application No. 2 311 342. This timepiece includes an hours wheel, centrally arranged, meshing with an intermediate wheel set, itself meshing with a driving wheel set or driver which controls, on the one hand, a star bearing the day disc indicator and, on the other hand, a crown with interior teeth forming a date ring.

The date ring and day star are respectively indexed, that is to say, brought to and maintained in a stable manner in a predetermined angular position by indexing means and in particular by jumper springs.

The driving wheel of the corresponding wheel set exhibits a plate which is cut out on the interior all around its rotation axis. The thus formed cut-out enables freeing a central hub which remains connected to said driving wheel through a single elastic arm of basically rectilinear form in rest position, arranged according to a radius of such wheel.

On such plate there is additionally arranged a thrust block which is capable of being brought to bear radially on the hub previously cited in order to assure in particular the transmission of a normal driving movement to the date ring and the day star, such driving movement being received from an intermediate wheel on the central hours wheel through the intermediate wheel set.

To this end the driving wheel includes, on one hand a salient tooth which is capable of being brought to mesh with the date ring and on the other hand a salient finger which is formed in order to control the day star at the same time as such salient tooth causes the date ring to advance through a step.

Every twenty-four hours the date ring as well as the day star simultaneously advance by one step, thanks to the joint action of the driving wheel and the jumper springs, this in a well-known standard manner.

The date ring may be manually adjusted in a standard manner by the user through action on an outer crown after the latter has been brought into a predetermined drawn-out position.

At any moment and among others, when the drive wheel is preparing to cause the date ring and the day star to advance, for example around midnight, the user has the possibility of changing the date indication provided by the corresponding ring. This action evidently has as a result the displacement of the date ring faster than the drive wheel. Thus, it is no longer the ring in question which is subjected to the driving action of the drive wheel, but rather the inverse. This is why there has been provided a ramp capable of supporting the motor action of the date ring teeth on the salient tooth which assures transmission of the couple, during a manual adjustment such as described hereinabove.

In such a case the drive wheel is pushed by one of the teeth of the date ring via the ramp arranged on the salient tooth, such push bringing about a displacement in translation in a substantially radial direction, that is to say, towards the intermediate wheel on the central hours wheel, such displacement being absorbed by the elastic coupling arm arranged between the central hub and the teeth of the drive wheel. The thrust block thus leaves its radial contact with the hub and the drive wheel may be elastically retracted without bringing about damage.

Although this arrangement exhibits the advantage of being of simple conception and assuring functional security during an adjustment of the date ring around midnight, it nevertheless presents difficulties.

Effectively, the user may also wish at any moment to modify the time displayed by the timepiece and no longer solely the dates. In such case, he again operates the outer crown in bringing it into a predetermined drawn-out position and in rotating it, drives in rotation the central hours wheel which drives in turn the drive wheel, but at a higher speed than in normal operation. If the adjustment of the time displayed takes place in the clockwise sense, there occurs (in passing through midnight) a normal advancing of the date ring and the day star as in the standard functioning of the timepiece such as explained hereinabove.

Nevertheless, if such adjustment is made in the counter-clockwise sense exactly after the date ring and the day star have advanced through a step, the salient tooth through its back ramp comes into contact with one of the teeth of the date ring while the salient finger comes into contact with one of the teeth of the day star.

From this moment, the drive wheel is radially displaced towards the central axis of the timepiece thanks to the elastic arm, this having a tendency to cause the salient finger to penetrate more into the teeth of the day star.

Consequently, the freeing in translation of the drive wheel through said elastic arm may not occur normally since the salient finger comes to block the assembly in bearing on one of the teeth of the day star.

It is for this reason that this type of adjustment may bring about an irreparable deterioration of one of the above-mentioned elements since in fact the salient finger cannot displace the day star, it being blocked by its jumper spring.

The other difficulty with this arrangement is that it necessitates the arrangement of an intermediate wheel set between the hours wheel and the driving wheel set, such arrangement necessitating machining and assembly operations increasing the overall price of the timepiece. It is noted effectively that the arrangement of such intermediate wheel set is almost indispensable since during its radial disengagement displacement the drive wheel is displaced in the direction of the day star—hours wheel assembly.

To this end, the present invention has as its first purpose to provide a timepiece including a peripheral crown or ring with interior teeth possibly associated with a day star centered on the timepiece and which may dispense with an intermediate wheel set between a drive wheel with elastic displacement and its motor wheel formed in particular by an intermediate wheel.

The present invention also has as purpose to provide a timepiece such as that mentioned hereinabove which may not be damaged whatever be the type of external adjustment effected by the user.

SUMMARY OF THE INVENTION

To this end, the present invention has as objective a timepiece of the type comprising:

a horometric movement including a motor pinion or intermediate wheel centered on the movement around a central axis, an indexed crown gear with interior teeth associated with a first display system, such as a date display, and with a jumper spring, a driving wheel set including a drive wheel controlled by the motor pinion and transmitting a motor couple received from said motor pinion to said crown gear through a salient tooth, such wheel set additionally including a hub which is mounted to rotate freely relative to the movement and which elastically supports said wheel through a first elastic arm, such arm being anchored on the hub and on the drive wheel respectively by a first and by a second anchor point, such timepiece being characterized in that said elastic arm which supports the drive wheel has a basically C form winding around the hub, while the drive wheel meshes directly with the motor pinion.

The present invention also has as objective a timepiece of the type comprising:

a horometric movement including a motor pinion or intermediate wheel centered on the movement around a central axis, an indexed crown gear with interior teeth associated with a first display system, such as a date display, and with a jumper spring, a driving wheel set including a drive wheel controlled by the motor pinion and transmitting a motor couple received from said motor pinion to said crown gear through a salient tooth, such wheel set additionally including a hub which is mounted to rotate freely relative to the movement and which elastically supports said wheel through a first elastic arm, such arm being anchored on the hub and on the drive wheel respectively by a first and by a second anchor point, an indexed star associated with a second display system such as a day of the week display and centered on the central axis, a driving finger mounted to rotate with the drive wheel through a second elastic arm in order to control the rotational displacement of the star, such timepiece being characterized in that said second elastic arm is directly anchored on said hub so as to enable said finger to be elastically displaced independently from the drive wheel.

Other characteristics and advantages of the invention will appear upon the reading of the following description of the embodiments given by way of example in connection with the attached drawings.

DESCRIPTION OF THE PREFERRED EMBODIMENTS

Figure 1:
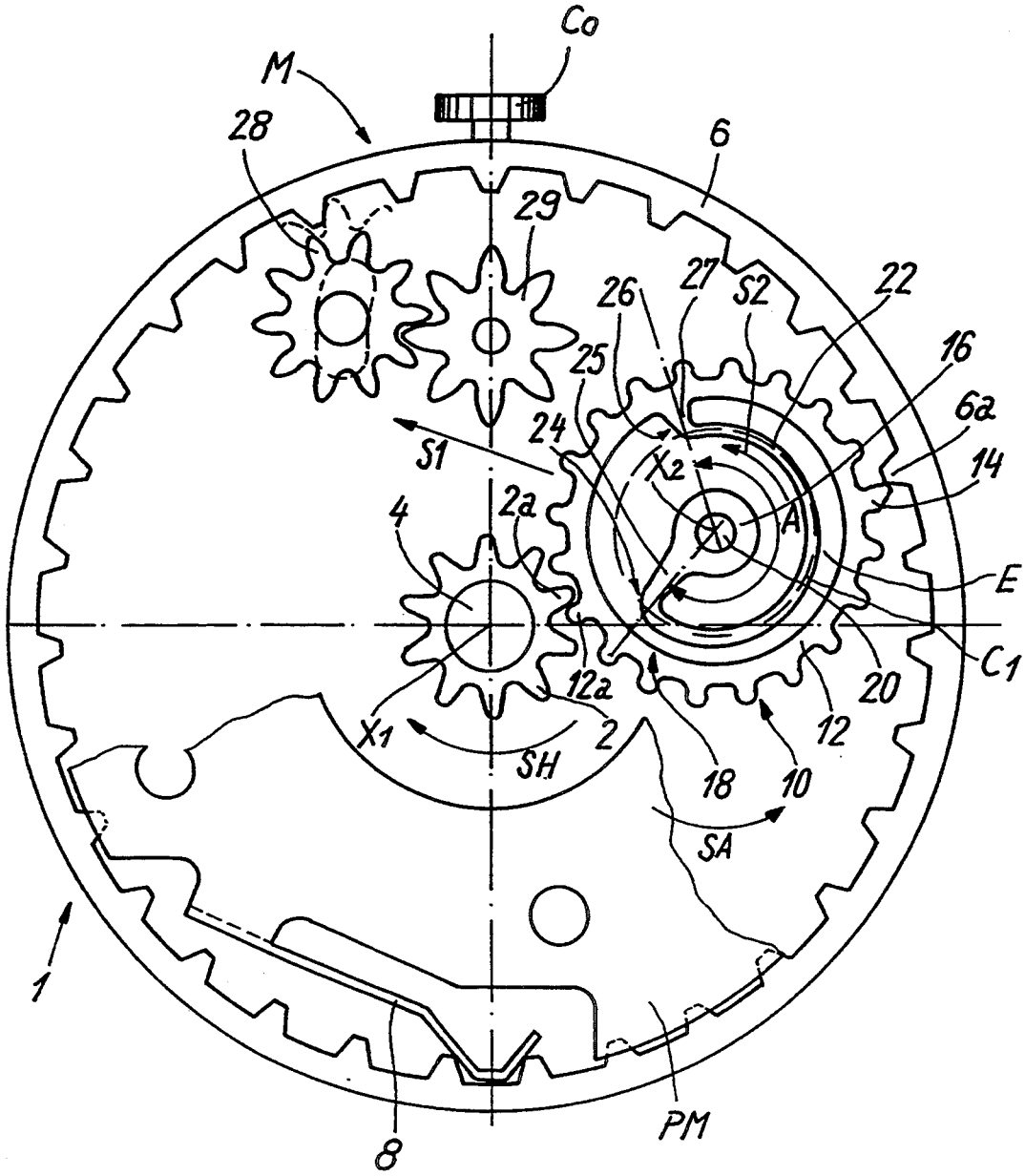
FIG. 1 shows a face view of a first embodiment of the timepiece according to the invention, in which are shown only elements necessary for the understanding of the invention.

Reference will be had initially to FIG. 1 for a description of a timepiece according to a first embodiment of the invention, which embodiment includes a single system date display and in particular a display system for the dates of the month.

The timepiece according to the invention includes an horometric movement identified by the general reference 1 which is of the mechanical or electromechanical type. Such horometric movement is not shown in detail since its components, other than those which constitute the invention, are standard and obtaining them is within the skill of the man of the art.

The horometric movement 1 includes a motor pinion or intermediate wheel 2 which is centered on movement 1 around a central axis referenced X1 and which is mounted on a pipe 4 supported by the base plate (not shown) of the horometric movement 1.

Movement 1 furthermore includes a crown 6 with interior teeth which is associated with a first display system such as a day of the month display. Such crown 6 is guided in rotation relative to the horometric movement 1 by standard means (not shown). Furthermore, it is axially maintained by a support plate PM also standard, here shown partially for better understanding of the invention.

This system may include inscriptions formed directly on crown 6 which, in this case, constitutes a date fine. It may include in a variant of the embodiment an additional disc attached directly onto crown 6, such disc here not being shown.

Crown 6 includes on its interior a certain number of teeth (in this case 31) which cooperate with a jumper spring 8 fixed to the support plate PM and forming an angular indexing means. Thus, such interiorly toothed crown 6 is indexed and may occupy different stable and predetermined angular positions which enable the inscription of the dates to appear facing an opening in a dial (not shown).

The timepiece according to the invention furthermore includes a driving wheel set 10 bearing a drive wheel or driver 12 which meshes directly with the motor pinion or intermediate wheel 2 and which is thus controlled by the latter.

Such drive wheel 12 includes a salient tooth 14 which, every 24 hours, comes to transmit a motor couple received from the motor pinion or intermediate wheel 2 to crown 6, in order to cause advancement of the dates inscription through one step.

The driving wheel set 10 further includes a hub 16 which is freely mounted for rotation around a geometric rotation axis X2 parallel to the central axis X1 and substantially displaced towards the exterior relative to the latter. To this effect hub 16 is mounted on a stud 20 fixed to a base plate (not shown) of the horometric movement 1. Hub 16 is situated within a plate 18 of the drive wheel 12, such plate 18 being cut out on the interior in order to form in its center a substantially annular cut-out referenced E. It will be noted that drive wheel 12 is cut out in a manner such that it exhibits a crown form with outer teeth.

Hub 16, which is freely mounted for rotation relative to the horometric movement 7, supports the drive wheel 12 elastically through a first elastic arm 22. Such elastic arm 22 is anchored, on one hand, on hub 16 at a first anchor point 24 and on the other hand on the cut-out plate or crown 18 at a second anchor point 26.

From the interior wall which defines the cut-out E of drive wheel 12, there extends radially a protuberance 27 which defines the second anchor point mentioned hereinabove. As to the first anchor point 24, this is defined by another protuberance bearing reference 25 which extends radially outwards from the outer periphery of hub 16. These two protuberances which respectively form the first anchor point 24 and the second 26 bear the essentially elastic portion of arm 22 on a geometric circle C1 which is, in its relaxed position here shown, perfectly concentric to drive wheel 12 as well as to hub 16 and to its rotation axis X2.

It will be noted consequently that elastic arm 22 exhibits a primarily circular form and that it extends over a predetermined arc length represented by angle A. The value of such angle varies between 225° and 240° and preferably has a value of 230°.

Such elastic arm 22 which consequently supports the drive wheel 12 and more specifically its plate or crown 18 on hub 16 exhibits a basically "C" form winding around hub 16.

It may also be specified that the C form of such first elastic arm 22 opens in a direction (or sense) S1 oriented substantially opposite to that of the salient tooth 14.

Additionally, the timepiece according to the invention includes a mechanism referenced M for time setting and rapid correction of the date. Such mechanism M which is standard includes a time setting crown CO which may control a sliding pinion 28 through a correction pinion 29.

In normal operation, the motor pinion or intermediate wheel 2 is driven in rotation by the horometric movement 1 in a rotation sense SH corresponding to the clockwise sense, which brings for example teeth 2*a* and 12*a* respectively of pinion 2 and of driving wheel 12 into contact.

The driving wheel 12 is thus in turn driven in rotation by the motor pinion or intermediate wheel 2 in an opposite sense of rotation SA (counter-clockwise sense) until the salient tooth 14 comes into contact with one of the teeth for example 6*a*, belonging to the indexed and interiorly toothed crown 6. The elastic arm 22 and the jumper spring 8 are calculated in a manner such that crown 6 is freed from the action of the jumper spring when the driving wheel 12 drives the crown 6 with its interior teeth in rotation in the counter-clockwise sense without the elastic arm 22 bending too much. It will be noted that to this end elastic arm 22 is oriented from its first anchor point 24 on hub 16 towards its second anchor point 26 on the plate 18 of driving wheel 12 in a sense S2 which is the same as the normal rotation sense of such wheel, corresponding to the counter-clockwise sense SA. Advancing of the crown 6 with its interior teeth 6 is standard and will not be described here in further detail.

Figure 2:
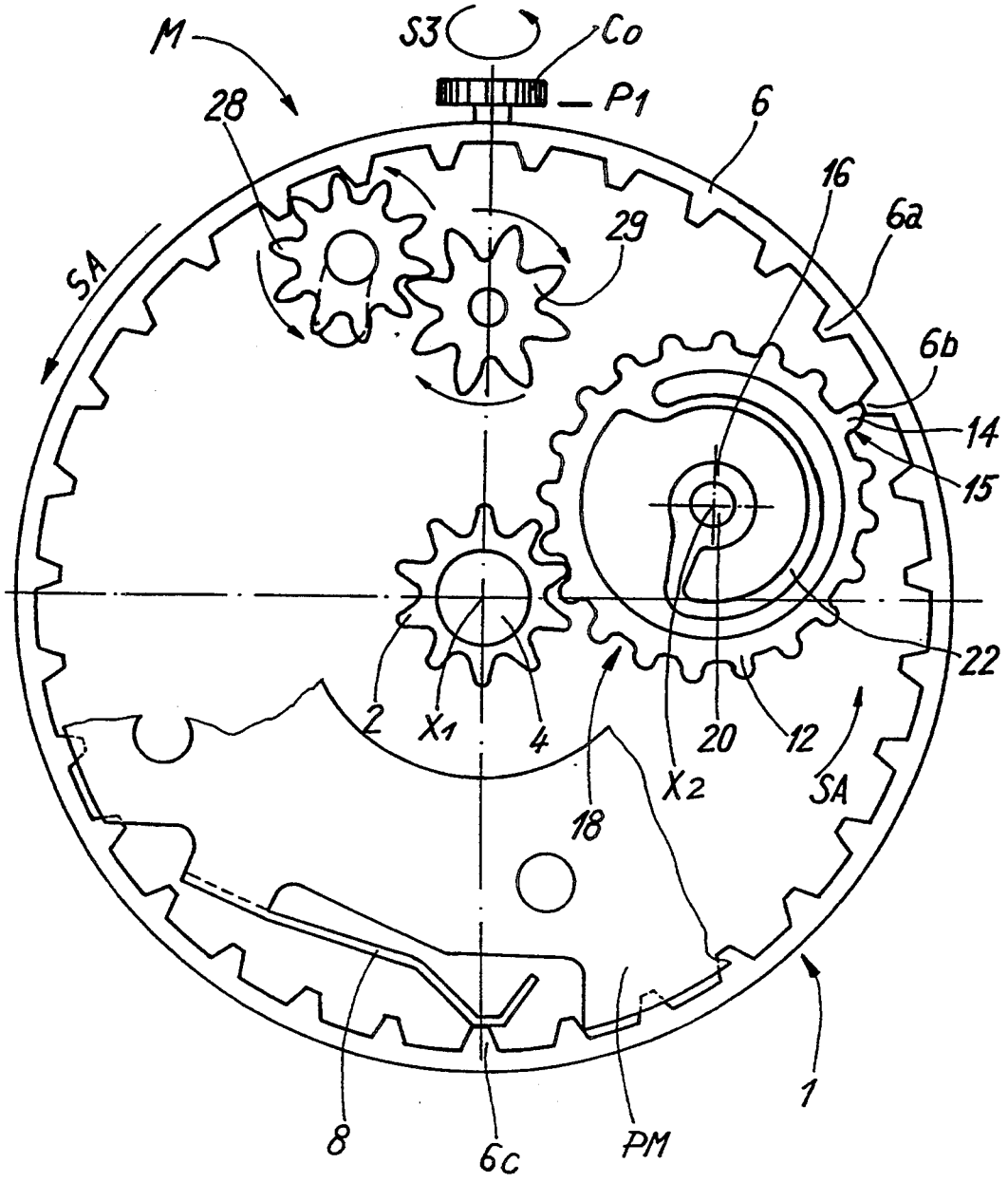
FIGS. 2 and 3 show the timepiece of FIG. 1 respectively during a rapid correction of the dates and during time setting in the counter-clockwise sense.

Referring now to FIG. 2, there has been shown the timepiece according to the invention during quick adjustment of the indexed crown 6 with its interior teeth. Such adjustment which will be also referred to as correction of the dates is effected in particular through the manual control crown CO.

Crown CO being brought into a predetermined drawn out position P1 by the user, it is next rotated in a rotation sense S3 which controls through pinion 29 the displacement in translation of sliding pinion 28 towards the interiorly toothed crown 6.

Sliding pinion 28 is thus brought into the position shown on FIG. 2 in which position it drives (always under action of the control crown CO) rotation of the interiorly toothed crown 6 in the counter-clockwise sense of rotation SA.

Thus, since crown 6 is displaced in rotation, one of its teeth referenced 6*b* comes directly into rear contact against the salient tooth 14 which, to this end, includes a ramp 15. It will be noted furthermore that at the same instant another tooth of crown 6 referenced 6*c*, retracts the jumper spring 8.

Thus, during this operation ramp 15 of the salient tooth 14 slides on tooth 6*b* of crown 6 and brings about a displacement of the driving wheel 12 around the motor pinion or intermediate wheel 2. The elastic arm 22 in its deformation enables the previously mentioned displacement of the driving wheel 12.

Should one rotate further the control crown CO, the salient tooth 14 is retracted relative to tooth 6*b* in order to fall into a rest position corresponding to that of FIG. 1, except that tooth 6*b* is then positioned in front of the salient tooth 14 and the crown 6 has advanced by one step. There thus appears on the dial, not shown of the timepiece according to the invention, an indication of the date corresponding to the following day.

Figure 3:
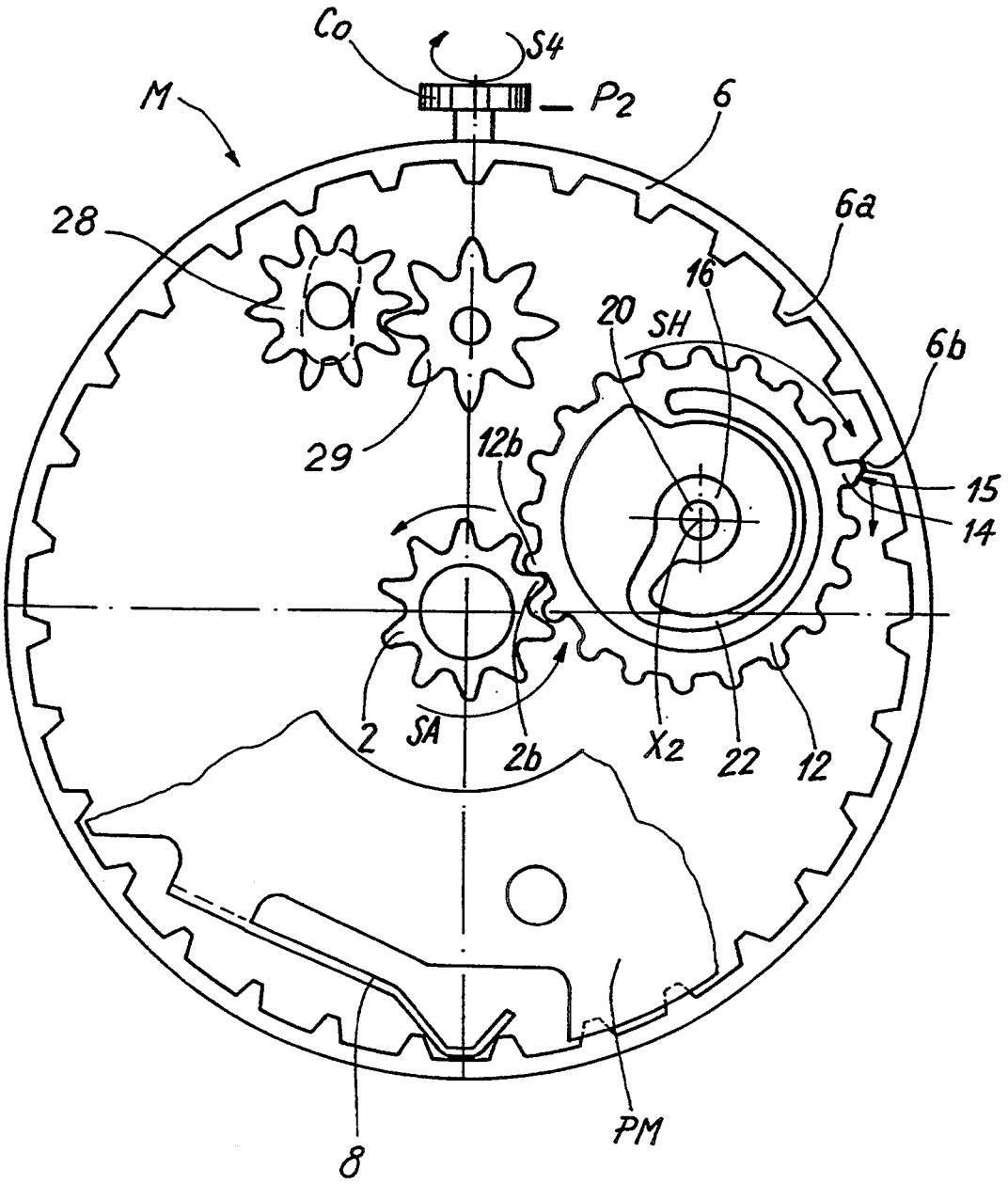

FIG. 3 shows another critical operating situation which corresponds to manual adjustment in the counter-clockwise sense SA of the hours and minutes indicators, not shown.

To bring about this correction, crown CO is drawn out into another position referenced P2 and is rotated by the user in a rotation sense S4 opposite to the rotation sense S3.

As is seen on this figure, such operation brings about rotation of the motor pinion or intermediate wheel 2 through a slight angle in the counter-clockwise sense SA since the intermediate wheel 2 is kinematically coupled in a standard manner to the hours wheel, this rotation driving a tooth of the motor pinion or intermediate wheel 2 referenced 2*b* to be brought to actuate a tooth 12*b* of wheel 12.

The driving wheel 12 being displaced in the clockwise rotation sense SH, ramp 15 of the salient tooth 14 comes to be retracted for example by tooth 6*b* of crown 6 which again provokes the deformation of elastic arm 22 and the subsequent displacement of the driving wheel 12 outside axis X2. It will be noted that in this case crown 6 is held immobile through action of the jumper spring 8.

Figure 4:
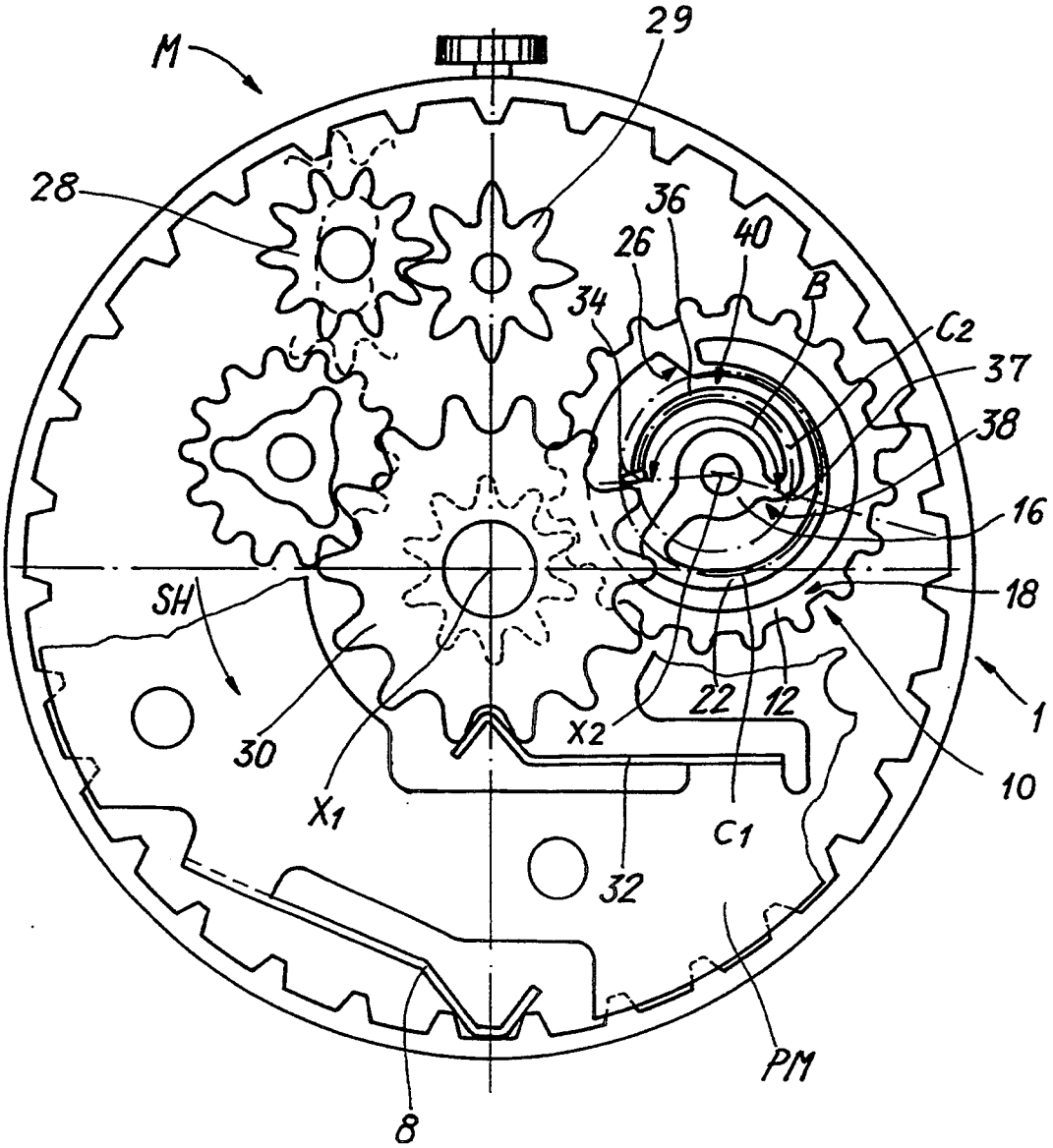
FIG. 4 shows a timepiece according to a second embodiment of the invention.
Figure 5:
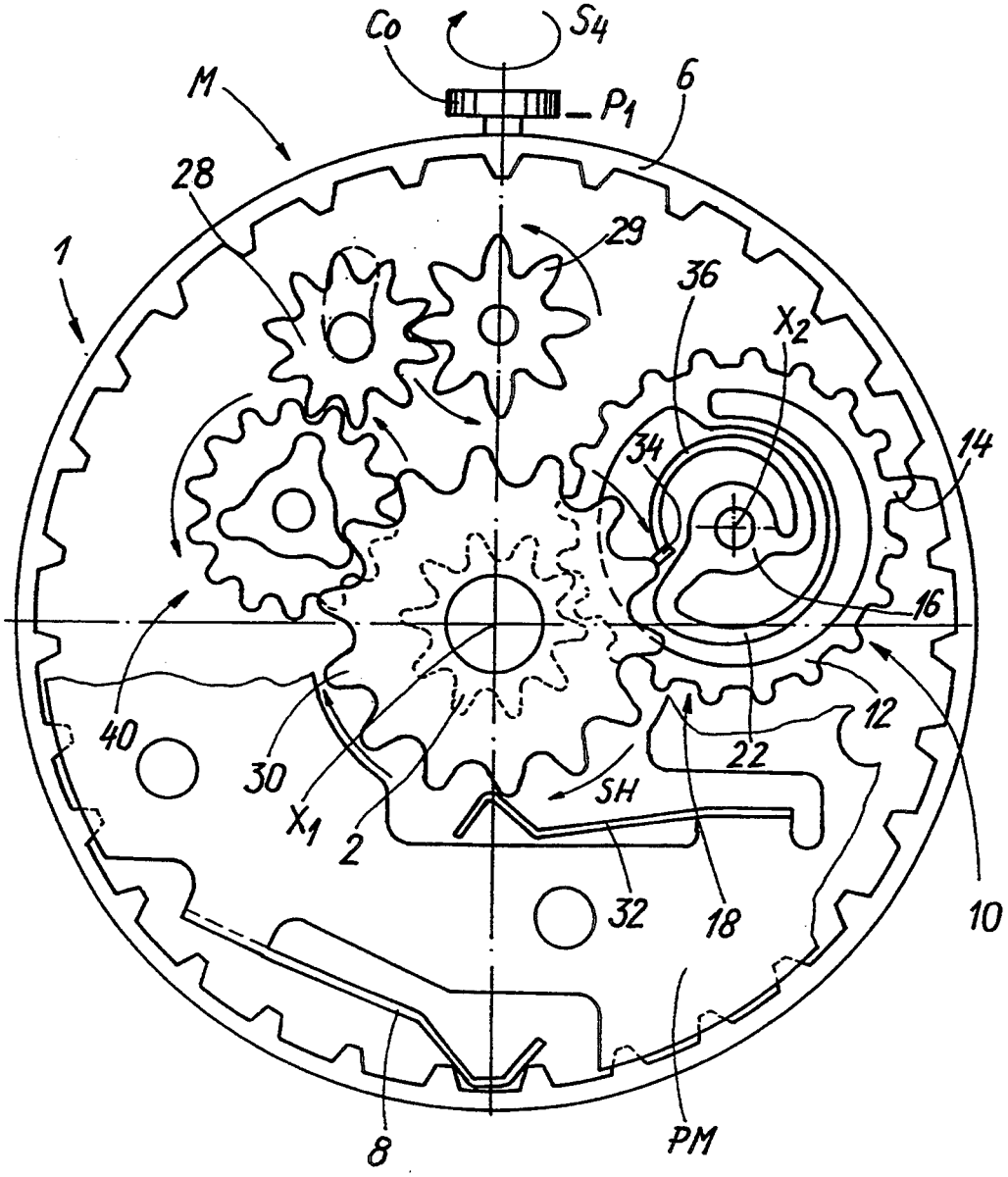
FIGS. 5 and 6 show the timepiece of FIG. 4 respectively during a rapid correction of the week days and during time setting in the counter-clockwise sense.
Figure 6:
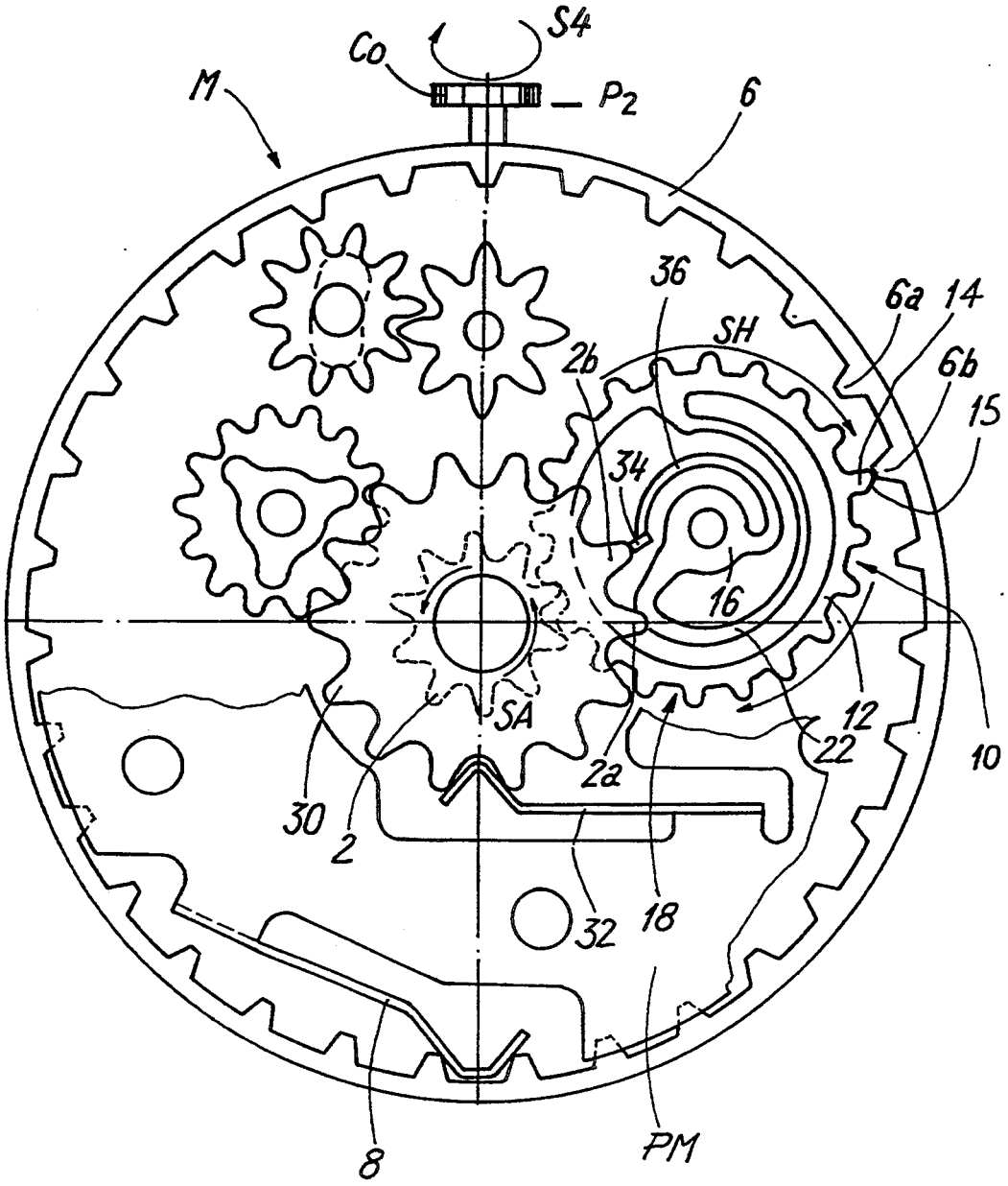

Referring next to FIGS. 4 to 6, there will be described hereinafter a second embodiment of the timepiece according to the invention.

Parts which are common to both embodiments of the invention in this figure bear the same reference numbers as those of the preceding figures.

In this second embodiment, the timepiece further includes a star 30 centered on axis X1 and which is mounted to rotate freely on a pipe not shown.

Star 30 is also indexed since it cooperates with a second jumper spring 32 which is fixed onto the plate PM bearing the jumper spring 8 previously described. Star 30 is associated with a second display system, such as a display of the day of the week, this latter adapted to be constituted by a disc on which are inscribed the different days of the week. The arrangement of such disc on star 30 being standard, it is accordingly not shown here.

The driving wheel set 10 further includes a driving finger 34 which is assembled to rotate with such wheel set 10 and thus with the driving wheel 12 through a second elastic arm 36. Driving finger 34 is accordingly raised out of the plane in which the elastic arm 36 is arranged in order to control the displacement in rotation of star 30.

It will be noted that according to the invention, such second elastic arm 36 is anchored directly on hub 16 and in particular on its outer periphery in order to permit finger 34 to be displaced elastically and independently relative to plate 18 of the driving wheel 12. The second elastic arm 36 shows, as does the first 22, a C form winding around hub 16. More specifically, the second elastic arm 36 extends from a protuberance 37 projecting radially from the outer periphery of hub 16 and bearing elastic arm 36 on a geometric circle C2 which is, in relaxed position, centered on the rotation axis X2 of hub 16 and substantially coaxial to circle C1 bearing the first arm 22.

Such second elastic arm 36 is thus anchored on hub 16 at a third anchor point referenced 38, such anchor point 38 being inscribed within the geometric circle C1 of the first elastic arm 22 so that the second elastic arm 36 extends partially into the C of the first arm 22. The second elastic arm 36 extends from its anchor point 38 on hub 16 over an angle B of about 180°. It will furthermore be noted that a median portion or head of such second arm 36 referenced 40 is arranged substantially facing anchor point 26 of the first arm 22. Such arrangement enables, during normal driving of the interiorly toothed crown 6 and star 30 by driving wheel 12 a stiffening of the second elastic arm 36 through a reduction of its rise length by a value substantially equal to two, since the anchor point 26 of the first elastic arm 22 comes to bear on the inflexion zone which forms the median portion 40 of the second elastic arm 36.

It will be understood that elastic arm 36 and consequently salient finger 34 may have a motion entirely independent of that of driving wheel 12.

Reference will now be had to FIG. 5 which shows the timepiece according to the second embodiment of the invention during a rapid correction of the days of the week.

To effect this operation, the control crown CO is drawn out into its position P1 and is rotated in a rotation sense S4 opposite to the rotation sense S3 (FIG. 2) which permits correction of the date.

Sliding pinion 28 is displaced through pinion 29 in the direction opposite to crown 6, towards a days correction wheel set 40 with which sliding pinion 28 comes into mesh.

The day star 30 is thus driven in rotation in the clockwise sense SH in order to enable display of the following day which incidentally brings about displacement of finger 34 towards hub 16 thanks to the second elastic arm 36. It will be noted that this displacement has no influence on the position of the plate 18 and thus on that of the wheel 12 which rests stable in its position.

After salient finger 34 has been completely retracted, thanks to the second elastic arm 36, it returns elastically into the teeth of star 30.

Reference will now be had to FIG. 6 which shows the timepiece according to this second embodiment during a time setting operation in the counter-clockwise sense.

The control or time setting crown CO being drawn out into its position P2 is rotated by the user in the rotation sense S4 which brings about, through a standard mechanism not shown, the subsequent displacement in rotation of intermediate wheel 2 in the counter-clockwise sense SA.

From here driving wheel 12 is displaced in rotation in the clockwise sense SH which is opposite to the rotation sense during normal operation.

In supposing that the salient tooth 14 at this instant is located before one of the teeth, for example **6*b*, of crown 6, in particular following the advance of crown 6 in the neighbourhood of midnight, such salient tooth 14 is retracted by its ramp 75 on tooth 6*b***.

Simultaneously, salient finger 34 which has just pushed star 30, is displaced in the backward sense and comes in turn to be retracted on one of the teeth, for example **2*b*, of star 30**.

This manoeuvre occurs without damage to the timepiece since it will be noted that the salient finger 34 and the salient tooth 14 may be elastically displaced independently from one another and this thanks to their kinematic coupling through two elastic arms respectively 22 and 36, in particular connected to a third common element, that is to say, hub 16.

This arrangement is thus perfectly reliable and offers security of operation whatever be the adjustment operations effected by the user from any position whatever and at any moment whatever.

It will be further noted that this configuration as well as that of the first embodiment enable direct driving of the driving wheel 12 by the motor pinion or intermediate wheel 2 without having an intermediate wheel set.

What I claim is:

1. A timepiece of the type comprising:

a horometric movement including a motor pinion or intermediate wheel centered on the movement around a central axis;

an indexed crown gear with interior teeth associated with a first display system, and with a jumper spring, a driving wheel set including a drive wheel having an outer toothing controlled by the motor pinion and transmitting a motor couple received from said motor pinion to said crown gear through a salient tooth, such wheel set additionally including a hub which is mounted to rotate freely relative to the movement and which supports said wheel, characterized in that said drive wheel is mounted on the hub through a first elastic arm anchored on the hub and on the drive wheel respectively by a first and by a second anchor point, which provides a floating elastic mounting of the drive wheel and its outer toothing with respect to the crown gear, the motor pinion and said hub.

2. A timepiece as set forth in claim 1 wherein said first elastic arm has a C form winding around said hub, from said first anchor point towards the second anchor point.

3. A timepiece as set forth in claim 1 wherein the C form of the first elastic arm is open in a sense oriented basically opposite to that of said salient tooth.

4. A timepiece as set forth in claim 1 wherein the first elastic arm in rest position extends over an angle ranging from 225° to 240°.

5. A timepiece as set forth in claim 4 wherein the first elastic arm in rest position extends over an angle of about 230°.

6. A timepiece as set forth in claim 1 comprising:

an indexed star associated with a second display system and centered on the central axis, a driving finger mounted to rotate with the drive wheel through a second elastic arm in order to control the rotational displacement of the star, said second elastic arm being directly anchored on said hub and exhibits a C form winding around the hub and extending partially into the C of the first arm.

7. A timepiece as set forth in claim 6 wherein the second elastic arm is anchored on the hub at an anchor point inscribed within the C of the first arm.

8. A timepiece as set forth in claim 6 wherein the second arm extends from its anchor point on the hub over an angle of about 180°.

9. A timepiece as set forth in claim 6 wherein the second arm extends relative to the first in a manner such that a median portion or head of such second arm is arranged substantially facing the anchor point of said first arm on the drive wheel.

10. A timepiece of the type comprising:

a horometric movement including a motor pinion centered on the movement around a central axis;

an indexed crown gear with interior teeth associated with a first display system, and with a jumper spring, a driving wheel set including a drive wheel having an outer toothing through which the drive wheel is driven by the motor pinion and transmitting a motor couple received from said motor pinion to said crown gear through a salient tooth, the wheel set further including a hub mounted to rotate freely relative to the movement and which supports said wheel, characterized in that said drive wheel is mounted on the hub through a first elastic arm anchored on the hub and on the drive wheel respectively by a first and by a second anchor point, which provides a floating elastic mounting of the drive wheel and its outer toothing with respect to the crown gear, the motor pinion and said hub.

* * * * *